US010509368B2

(12) United States Patent
Da Ros et al.

(10) Patent No.: US 10,509,368 B2
(45) Date of Patent: Dec. 17, 2019

(54) BOX INCLUDING A DEVICE FOR RETAINING A TIMEPIECE COMPONENT IN POSITION

(71) Applicant: ROLEX SA, Geneva (CH)

(72) Inventors: Jérôme Da Ros, Marin (FR); Marc Demierre, Oron-la-Ville (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 16/383,802

(22) Filed: Apr. 15, 2019

(65) Prior Publication Data

US 2019/0317453 A1 Oct. 17, 2019

(30) Foreign Application Priority Data

Apr. 17, 2018 (EP) ..... 18167846

(51) Int. Cl.

| | |
|---|---|
| ***A45C 11/10*** | (2006.01) |
| ***G04D 1/06*** | (2006.01) |
| ***B65D 85/40*** | (2006.01) |

(52) U.S. Cl.

CPC ..... *G04D 1/066* (2013.01); *A45C 11/10* (2013.01); *B65D 85/40* (2013.01)

(58) Field of Classification Search

USPC ..... 206/301, 18, 303

See application file for complete search history.

(56) References Cited

U.S. PATENT DOCUMENTS

| | | | | |
|---|---|---|---|---|
| 4,034,849 A * | 7/1977 | Zakrajsek | A45C 11/10 | 206/752 |
| 5,752,600 A * | 5/1998 | Kurashina | B65D 85/40 | 206/301 |
| 7,228,963 B1 * | 6/2007 | Feibelman | A47F 7/022 | 206/1.5 |
| 8,490,787 B2 * | 7/2013 | Biedermann | A45C 11/10 | 206/301 |
| 2010/0294675 A1 | 11/2010 | Mangano | | |

FOREIGN PATENT DOCUMENTS

| | | |
|---|---|---|
| CH | 208583 A | 2/1940 |
| CH | 368049 A | 3/1963 |
| CN | 203619190 U | 6/2014 |
| DE | 1 695 035 U | 3/1955 |
| DE | 1 803 090 U | 12/1959 |

OTHER PUBLICATIONS

European Search Report and Written Opinion dated Oct. 15, 2018 issued in counterpart application No. EP18167846; w/ English machine translation (17 pages).

* cited by examiner

*Primary Examiner* — Jacob K Ackun
(74) *Attorney, Agent, or Firm* — Westerman, Hattori, Daniels & Adrian, LLP

(57) ABSTRACT

The invention concerns a box including a device for retaining in position a timepiece component. The device includes: —a base (2); —a support (3, 4) comprising a first part (3) and a second part (4), the first part being mounted to be mobile relative to the second part; —a first contact element (3*a*, 3*b*) intended to come to bear against the timepiece component, the first contact element (3*a*, 3*b*) being mounted on the first part, and a second contact element (4*a*) intended to come to bear against the timepiece component (5), the second contact element (4*a*) being mounted on the second part (4); and—a control member (1) mounted to pivot on the base (2) about a first axis (1*a*) on the one hand and pivoting the first part about a second axis (1*b*) on the other hand.

20 Claims, 12 Drawing Sheets

BOX INCLUDING A DEVICE FOR RETAINING A TIMEPIECE COMPONENT IN POSITION

This application claims priority of European patent application No. EP18167846.7 filed Apr. 17, 2018, the content of which is hereby incorporated by reference herein in its entirety.

The invention concerns a device for retaining a timepiece component in position. The invention also concerns a box for packaging a timepiece component, in particular a box including this kind of retaining device.

The need to package objects in order to be able to transport them, store them, manipulate them or display them without damaging them is well known. Numerous packaging techniques and materials have been developed over the years to protect objects of very different kinds as to their size, their shape, their fragility, for example.

Prior art packaging techniques and materials are either very specialized bespoke designs or more general purpose designs suiting a greater variety of objects. Moreover, it is known that some packaging techniques and materials are better suited to packaging particularly fragile objects because, given their impact dissipation or absorption characteristics, they protect the objects against corresponding damage.

Consequently, it will be appreciated that particular packaging techniques and materials are often chosen and designed for particular objects or articles as a function of the stresses to which the object is liable to be subjected during shipping, transportation or handling, such as for example impact, dropping, or rubbing. For particularly fragile objects it is equally important to protect them from the external environment, in particular from dust, pollution, moisture and electric charges and possible contamination (such as by volatile organic compounds for example) that may arise from the packaging itself.

Also, it may be necessary to be able to remove the object from the packaging and to replace it therein afterwards. If the objects have particularly fragile surfaces, it is important that these manipulations do not degrade the integrity of the object to be packaged.

One widely known technique for providing general purpose shock absorbency for fragile objects is the membrane packaging technique. An alternative solution consists in using a shape memory foam, like that disclosed in the patent application US20100294675. Although very effective where protection against impact is concerned, these techniques do not enable the surface of the object to be projected from contact or from contamination caused by the packaging, for example by volatile organic compounds, and do not facilitate handling the object.

General purpose packaging has been developed enabling transportation, storage and display of components. These boxes are generally provided with an insert serving as a support. Some of those inserts can be pivoted on the bottom of the box and must be lowered or raised by hand as disclosed in the document CN203619190U or by a mechanism connected to the lid as disclosed in the document CH368049A. The insert is designed for a predefined object. The disadvantage of these solutions is that they do not provide satisfactory retention of the object to be packaged and do not enable the integrity of the latter to be preserved. Moreover, the function of retaining the object is decoupled from the action of opening/closing the mechanism for actuating the insert, whence an increased risk of the object deteriorating when the box is handled by an operative.

Although prior art packaging offers good protection for fragile objects against impacts and vibrations, large contact zones are necessary to achieve or to maintain the required shock absorbing criteria. Also, the retaining means make manipulation of the object delicate and are optimized only for objects of the same size or possibly having a standardized fixing zone dedicated to this purpose.

In fact, in many forms of prior art packaging the packaging is not general purpose. Either it is able to contain objects with varied dimensions but is liable to damage, mark or pollute functional or fragile surfaces of the package object, because it is liable to come into contact with the entirety of the latter, or it is designed for a single and unique object of predetermined size. Moreover, although handling the packaged object is facilitated, this is to the detriment of the quality of the retention of the object and consequently the protection of the integrity of the latter.

The object of the invention is to provide a retaining device enabling the disadvantages mentioned above to be remedied and improving known prior art devices. In particular, the invention proposes a simple and general purpose device offering excellent qualities in terms of retaining and protecting a timepiece component.

A device according to the invention for retaining a component in position is defined by point 1 below.

1. A device for retaining in position a timepiece component, the device including:
   a base;
   a support comprising a first part and a second part, the first part being mounted to be mobile relative to the second part;
   a first contact element intended to come to bear against the timepiece component, the first contact element being mounted on the first part, and a second contact element) intended to come to bear against the timepiece component, the second contact element being mounted on the second part; and a control member mounted to pivot on the base about a first axis on the one hand and pivoting the first part about a second axis on the other hand.

Different embodiments of the retaining device are defined by dependent points 2 to 11 below.

2. The device as defined in the preceding point, wherein the second part is mounted to be mobile relative to the base about a third axis (2*a*).
3. The device as defined in either one of the preceding points, wherein the first and second parts are connected by a prismatic joint or a sliding connection, the first part in particular forming a rail and the second part in particular forming a slide or the second part forming a rail and the first part forming a slide.
4. The device as defined in point 2, wherein the first and second parts are connected by a pivot connection having a fourth axis perpendicular or substantially perpendicular to a plane passing through the first and third axes.
5. The device as defined in the preceding point, wherein the first part includes at least one first arm and the second part includes a second arm.
6. The device as defined in the preceding point, wherein the first arm is articulated at the level of the second axis parallel to the fourth axis and wherein the second arm is articulated at the level of the third axis parallel to the fourth axis.
7. The device as defined in any one of points 4 to 6, including at least two first parts (3) and at least two second parts.

8. The device as defined in point 1, wherein the second part is mounted to be immobile relative to the base.
9. The device as defined in either one of points 1 or 8, wherein the first part is mounted to be mobile relative to the second part by a pivot connection a fifth axis (1*c*) of which is mobile in a slide, in particular a slide having an axis perpendicular to the first axis and/or to the second axis.
10. The device as defined in any one of the preceding points, wherein the device is arranged such that, when the control member is moved to pivot about the first axis, the second axis follows a trajectory that intersects a plane defined as passing through:
    the third axis or the fifth axis, and
    the first axis,
    and such that when the second axis is positioned at this intersection maximum elastic potential energy is stored in the device, in particular in the support.
11. The device as defined in any one of the preceding points, wherein:
    the second part is mounted to be mobile relative to the base about a third axis and/or the first part is mounted to be mobile relative to the second part about a fifth axis and the contact elements extend perpendicularly or substantially perpendicularly to a plane passing through the second and third axes or through the second and fifth axes; and/or
    the contact elements are frustoconical; and/or
    at least one of the first and second contact elements is mounted on the support via an elastically deformable connection; and/or
    at least one of the first and second support parts is mounted on the base or on the control member via an elastically deformable connection.

A box according to the invention for packaging or storing a timepiece component is defined by point 12 below.

12. A box for packaging a timepiece component including at least one retaining device as defined in any one of points 1 to 11.

Different embodiments of the box are defined by dependent points 13 to 15 below.

13. The packaging box as defined in the preceding point, wherein the retaining device is mounted on a box structure, in particular on a box bottom.
14. The packaging box as defined in point 12, wherein an element of the retaining device, in particular the base, is made in one piece with the box structure, in particular with a bottom of the box.
15. The packaging box as defined in any one of points 12 to 14, wherein the box includes a lid articulated on a box bottom about the second axis, the control member consisting of the lid.

The appended figures represent by way of example two embodiments of a box for packaging a timepiece part.

Figure 1:
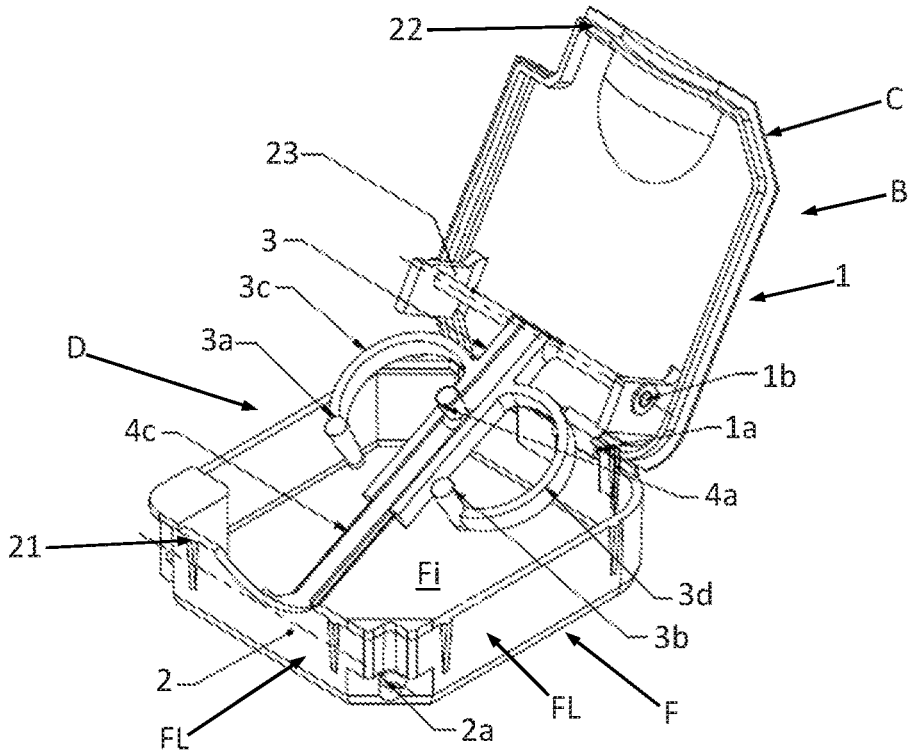
FIG. 1 is a view of a first variant of a first embodiment of a box for packaging a timepiece component in an open position.

A first embodiment of a box B is described hereinafter with reference to FIGS. 1 to 19.

The box B mainly comprises a bottom F and a lid C.

For example, the bottom comprises a bottom wall Fi and lateral walls FL. The bottom wall is for example plane or substantially plane. The lateral walls preferably extend from the periphery of the bottom wall. The lateral walls extend for example perpendicularly or substantially perpendicularly to the bottom wall. The bottom has for example four lateral walls. Lateral walls may be connected to one another by connecting radii. The latter may for example have conformations so as to optimize and/or to facilitate stowing the boxes in a packaging tray.

The lid C includes for example a plane or substantially plane wall. The bottom and the lid are complementary to define a volume internal to the box that is more or less closed, or even more or less sealed, when the lid is in the closed position.

One or more or all the lateral walls may be produced on the lid. Another alternative is for one or more or all the lateral walls to be produced in a complementary way and at least in part on the bottom and in part on the lid.

The lid is preferably pivoted to the bottom about a first axis 1*a*. This first axis 1*a* is for example disposed at one extremity of a lateral wall and/or along a lateral wall. Pivoting is advantageously provided by a hinge.

The box B enables packaging of a timepiece component 5, in particular during its transportation or during its storage.

The box B includes at least one support 3, 4 adapted to receive a timepiece component 5 and configurable between a first state or configuration retaining the timepiece component 5 and a second state or configuration releasing the timepiece component. It is therefore possible to act on the box B to move the support from a configuration retaining the timepiece component 5 to a configuration releasing the timepiece component 5 or to move the support from the configuration releasing the timepiece component 5 to the configuration retaining the timepiece component 5.

For example the configuration of the support 3, 4 is determined by the position of the lid C of the box B.

The box B for packaging a timepiece component 5 advantageously includes at least one device D for retaining the timepiece component 5. In our embodiments, the bottom F forms a base or a frame 2.

The device D for retaining the timepiece component 5 in position comprises:

- a support 3, 4 comprising a first part 3 and a second part 4, the first part 3 being mounted to be mobile relative to the second part;
- a base or a frame 2 adapted to receive and to serve to support or to fix the support 3, 4;
- a first contact element 3*a*, 3*b* intended to come to bear against the timepiece component, the first contact element 3*a*, 3*b* being mounted on the first part 3, and a second contact element 4*a* intended to come to bear against the timepiece component, the second contact element 4*a* being mounted on the second part 4; and
- a control member 1 mounted on the base 2 to pivot about the first axis 1*a* on the one hand and mounted to pivot relative to the first part 3 about a second axis 1*b* on the other hand.

The control member may form a lever connecting the first and second axes.

The second part 4 is preferably mounted to be mobile relative to the base about a third axis 2*a*, and in particular the second part 4 is preferably mounted to pivot relative to the base about the third axis 2*a*.

The first, second and third axes are preferably parallel or substantially parallel.

The third axis 2*a* is preferably positioned in the space delimited by the lateral walls FL of the bottom, advantageously in the vicinity of or at the level of the bottom wall Fi of the bottom.

The first support part 3 mainly comprises a T-shaped rigid part. The first part 3 of the support includes a first bar 3*m* arranged coaxially with the second axis 1*b* and a second bar 3*n* arranged perpendicularly or substantially perpendicularly to the first bar 3*m*.

In the first two variants of the first embodiment the second support part 4 includes a third bar 4*m* arranged coaxially with the axis 2*a* and a fourth bar 4*n* arranged perpendicularly or substantially perpendicularly to the third bar 4*m*. The second and fourth bars 3*n*, 4*n* are arranged along an axis A1.

The third bar 4*m* may pivot about the third axis 2*a* in the vicinity of or at the level of the bottom wall Fi of the bottom or on the lateral walls FL of the bottom. For example it may pivot on the lateral walls FL.

The first bar 3*m* may pivot about the second axis 1*b* in the vicinity of or at the level of the lid C.

For example, the support may be symmetrical with respect to a plane passing through the axis A1.

In the first embodiment the first support part 3 is mounted to be mobile relative to the second support part 4, and for example the first support part 3 is mounted to slide relative to the second support part 4 along an axis. In the first two variants of the first embodiment the mechanical connection between the first support part 3 and the second support part 4 is a sliding connection, in particular a prismatic joint, along axis A1 so as to enable relative movement in translation between the first and second support parts along that axis A1. The sliding connection comprises a first guide element 3*f* on the first support part 3 cooperating with a second guide element 4*c* on the second support part 4. For example the first guide element 3*f* has a profile having a C-shape section and the second guide element 4*c* has a profile having a section at least partly complementary to the C-shape section, in particular a rectangular section. Alternatively, the second guide element 4*c* may have a profile having a C-shape section and the first guide element 3*f* may have a profile having a section at least partly complementary to the C-shape section, in particular a rectangular section. The profiles may alternatively have varied section shapes, such as a dovetail-shaped section, provided that they allow sliding.

Alternatively or additionally the second guide element 4*c* may include at least one rail adapted to cooperate with a slide and the second guide element 3*f* may include said slide.

Alternatively or additionally the second guide element 4*c* may include at least one slot adapted to cooperate with a slide and the second guide element 3*f* may include said slide.

Alternatively or additionally the second guide element 4*c* may include at least one fixed slide adapted to cooperate with a rail 3*f* or a slot.

Alternatively or additionally the second guide element 4*c* may include at least one male slide adapted to cooperate with a female slide 3*f*.

In a first variant of the first embodiment shown in FIGS. 1 to 9 the device includes two first contact elements 3*a*, 3*b*. These two contact elements are mounted on the first support part 3. Moreover, the device includes a second contact element 4*a*. That second contact element is mounted on the second support part 4.

The first contact elements 3*a*, 3*b* preferably extend perpendicularly or substantially perpendicularly to the first support part 3, i.e., perpendicularly or substantially perpendicularly to a plane defined by the longitudinal directions of the first bar 3*m* and the second bar 3*n*.

The second contact element 4*a* preferably extends perpendicularly or substantially perpendicularly to the second support part 4, i.e., perpendicularly or substantially perpendicularly to a plane defined by the longitudinal directions of the third bar 4*m* and the fourth bar 4*n*.

The first and second contact elements 3*a*, 3*b*, 4*a* preferably extend perpendicularly or substantially perpendicularly to a plane passing through the axes 1*b* and 2*a*.

Each of the first contact elements 3*a*, 3*b* is mechanically connected to the first support part 3 by way of an elastically deformable connection 3*c*, 3*d*. They could be collectively mechanically connected to the first support part 3 by way of a single elastically deformable connection.

The second contact element 4*a* is rigid mechanically connected to the second support part. Alternatively, it could be mechanically connected to the second support part via an elastically deformable connection.

The elastically deformable connection or connections is or are for example provided by one or more springs, in particular one or more leaf springs. The leaf spring or springs is or are preferably curved, in particular of spiral shape. For example, the tangents to the two ends of a spring form between them an angle of more than 90° or even more than 150°.

The leaf springs preferably extend parallel or substantially parallel to a plane passing through the axes 1*b* and 2*a*.

At the level of the contact element the leaf springs may extend parallel or substantially parallel to the surface of the timepiece component 5 on which the contact element is intended to come to bear.

The second axis 1*b* about which the first support part 3 pivots relative to the lid is disposed at a distance from the first articulation axis 1*a* of the lid C on the bottom. For example the axis is retained in two projections 23 extending perpendicularly from the internal face of the lid.

The lid C therefore constitutes the control member 1 maintaining a constant distance between the first and second axes 1*a* and 1*b*.

Thus maneuvering the lid moves the second axis 1*b* in rotation relative to the first axis 1*a*.

The base may include a first abutment 21 designed to cooperate by contact with a second abutment 22 to limit the rotation of the support relative to the third axis 2*a*. In fact, once the two abutments are in contact the support is no longer able to turn about the third axis 2*a*, i.e., the support can no longer be moved toward the bottom wall Fi of the bottom.

In the first variant of the first embodiment described above with reference to FIGS. 1 to 9 the contact elements are such that the first contact elements are moved away from the second contact element along the axis A1, more generally at least one contact element is moved away from at least one other contact element, when the lid of the box is closed. Consequently, this first variant enables a timepiece component 5 to be retained via the interior of said timepiece component. A first variant of this kind is therefore particularly indicated for storing timepiece components having an angular shape or more generally components including a bore such as for example a bezel, a middle or a calendar disk.

A second variant of the first embodiment of a box B is described hereinafter with reference to FIGS. 10 to 16.

This second variant of the first embodiment differs mainly or even exclusively from the first variant in that the contact elements are such that first contact elements are moved toward second contact elements along the axis A1, more generally at least one contact element is moved toward at least one other contact element when the lid of the box is closed. Consequently, this second variant enables retention of a timepiece component 5 from the exterior. Accordingly, a second variant of this kind is particularly indicated for the storage of timepiece components having a solid shape, for example a glass, a plate, a movement, a case or a dial.

In this second variant of the first embodiment, the device includes two first contact elements 3*a*, 3*b*. These two contact elements are mounted on the first support part 3. In addition, the device includes two second contact elements 4*d*, 4*e*. These two contact elements are mounted on the second support part 4.

The first contact elements 3*a*, 3*b* preferably extend perpendicularly or substantially perpendicularly to the first support part 3, i.e., perpendicularly or substantially perpendicularly to a plane defined by the longitudinal directions of the first bar 3*m* and the second bar 3*n*.

The second contact elements 4*d*, 4*e* preferably extend perpendicularly or substantially perpendicularly to the second support part 4, i.e., perpendicularly or substantially perpendicularly to a plane defined by the longitudinal directions of the third bar 4*m* and the fourth bar 4*n*.

The first and second contact elements 3*a*, 3*b*, 4*d*, 4*e* preferably extend perpendicularly or substantially perpendicularly to a plane passing through the axes 1*b* and 2*a*.

Each of the first contact elements 3*a*, 3*b* is mechanically connected to the first support part 3 by way of an elastically deformable connection 3*c*, 3*d*. They could collectively be mechanically connected to the first support part 3 by way of a single elastically deformable connection.

Each of the second contact elements 4*d*, 4*e* is mechanically connected to the second support part 4 by way of an elastically deformable connection 4*f*, 4*g*. They could be collectively connected mechanically to the second support 4 by way of a single elastically deformable connection.

The elastically deformable connection or connections is or are for example produced by one or more springs, in particular one or more leaf springs. The leaf spring or springs is or are preferably curved. For example the tangents to the two ends of a spring form between them an angle of more than 90° or even of more than 150°.

At the level of the contact element the leaf springs may extend parallel or substantially parallel to the surface of the timepiece component 5 on which the contact element is intended to come to bear.

Figure 17:
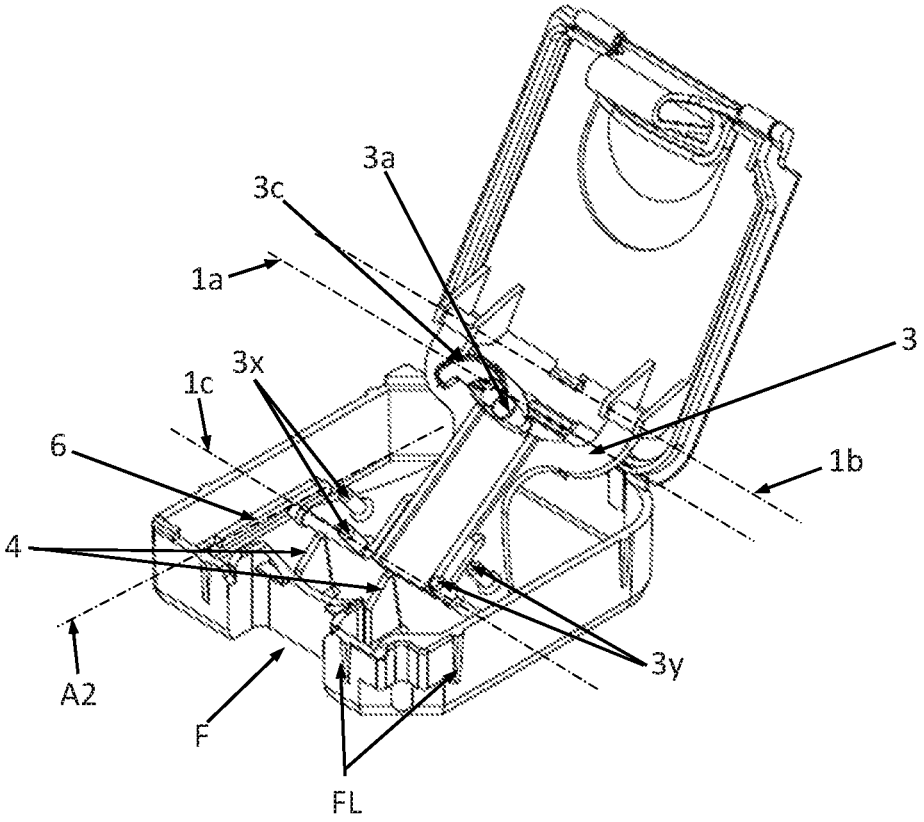
FIG. 17 is a view of a third variant of the first embodiment of a box for packaging a timepiece component in the open position.
Figure 18:
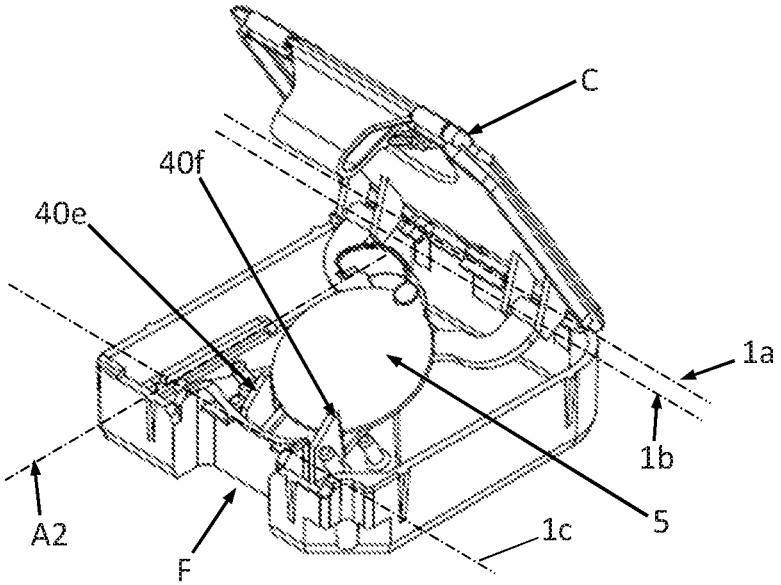
FIG. 18 is a view of the third variant of the first embodiment of the box for packaging the timepiece component in the half-open position with the timepiece component in the box.

A third variant of the first embodiment of a box B is described hereinafter with reference to FIGS. 17 to 19.

This third variant of the first embodiment differs from the second variant in that the second support part 4 is mounted in a non-mobile manner relative to the bottom F. The second support part 4 is advantageously in one piece with the bottom F. The second support part 4 may for example include two projections 40*e* and 40*f*. The second support part 4 includes at least one contact element 40*e*, 40*f* intended to come to bear against the timepiece component 5 in the retaining configuration.

The first support part 3 is mounted to pivot about a fourth axis 1*c* on the base. However, in this variant the fourth axis 1*c* is moved along an axis A2 as the control member is maneuvered. Here the axis A2 is oriented perpendicularly or substantially perpendicularly to the first axis 1*a* and/or the second axis 1*b* and/or parallel to the bottom wall Fi of the base. In this third variant of the first embodiment, the connection with axis A2 is provided to enable relative movement between the first and second support parts 3, 4 along this axis A2.

In this variant embodiment, the connection with axis A2 is a sliding connection. The sliding connection may be provided by grooves 6 on the flanks FL of the bottom F in which the two ends of a shaft with the fourth axis 1*c* are intended to move. The first support part 3 includes a first contact element 3*a* intended to come to bear against the timepiece component 5. The first contact element 3*a* is mechanically connected to the first support part 3 via an elastically deformable connection 3*c*, in particular a leaf spring. The first support part 3 advantageously includes supplementary contact elements 3*x*, 3*y* adapted to improve the support of the component in the release configuration.

Figure 19:
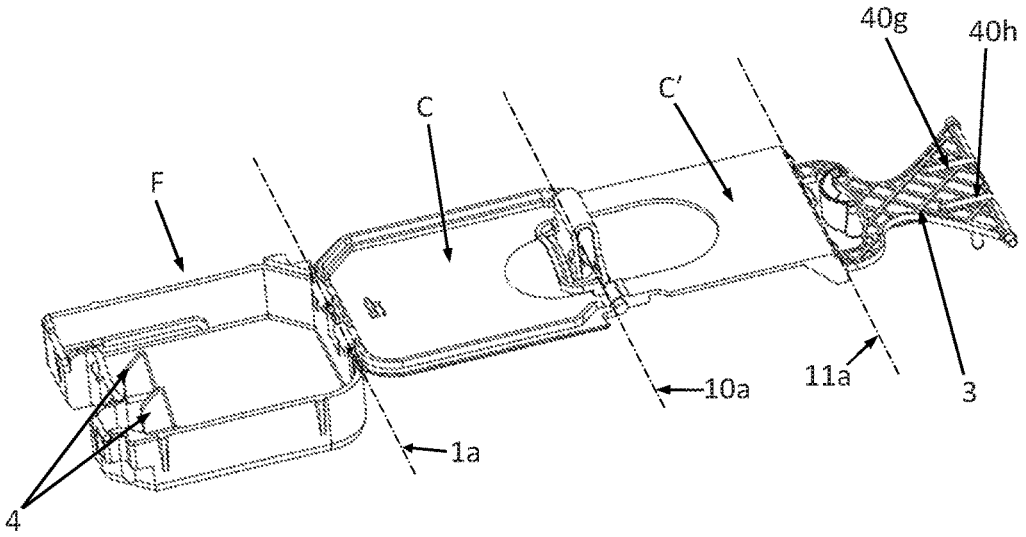
FIG. 19 is a deployed view of an alternative to the third variant of the first embodiment.
Figure 20:
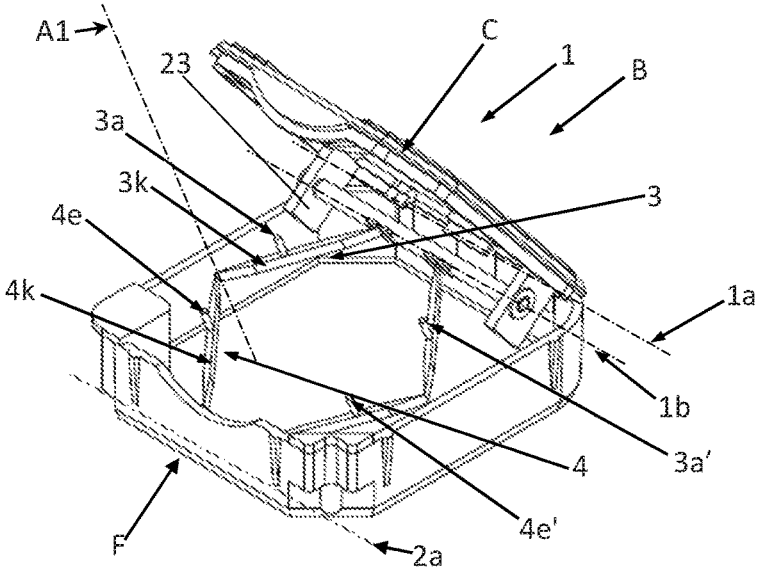
FIG. 20 is a view of a second embodiment of a box for packaging a timepiece component in the half-open position.

In one particular execution of the third variant, the device D and the box B are injection molded unfolded and in one piece, as shown in FIG. 19. In this particular execution of the third variant, the first support 3 is connected to the lid C by a connecting lid C'. The first support 3 and the connecting lid C' are connected via a hinge, in particular a film-hinge 11*a*. The connecting lid C' and the lid C are connected by a second hinge, in particular a hinge-film 10*a*. The lid C and the base 2 are connected by a third hinge, in particular a film-hinge 1*a*. The connecting lid C' is folded and fixed to the lid C, for example clipped to it or fixed by any other appropriate means so that they come to be integral with one another. The shaft with the fourth axis 1*c* can then be inserted in the grooves 6.

A second embodiment of a box B is described hereinafter with reference to FIGS. 20 to 23.

This second embodiment differs from the first embodiment mainly in that the support has a different structure.

In the second embodiment, the second support part is also mounted to be mobile relative to the base about the third axis 2*a* and the first support part 3 is also mounted to be mobile relative to the control member about the second axis 1*b*. However, the first and second support parts 3, 4 are connected by a pivot connection with axis A1 perpendicular or substantially perpendicular to a plane passing through the second and third axes 1*b* and 2*a*.

The first support part 3 includes at least one first arm 3*k*. The second support part includes at least one second arm 4*k*.

The first arm 3*k* and the second arm 4*k* are connected by the pivot connection with axis A1 for example.

The at least one first arm 3*k* is articulated at the level of the second axis 1*b* parallel or substantially parallel to the axis A1.

The at least one second arm 4*k* is articulated at the level of the third axis 2*a* parallel or substantially parallel to the axis A1.

As shown in FIGS. 20 to 23 the device D may advantageously be duplicated and seen as including two first support parts 3*k* and two second support parts 4*k*.

In this second embodiment, the device includes at least one first contact element 3*a*. That contact element is mounted on at least one first support part 3. In addition, in this second embodiment the device includes at least one second contact element 4*e*. That second contact element 4*e* is mounted on at least one second support part 4.

The at least one first contact element 3*a* preferably extends perpendicularly or substantially perpendicularly to the at least one first support part 3.

The at least one second contact element 4*e* preferably extends perpendicularly or substantially perpendicularly to the at least one second support part 4.

The first and second contact elements preferably extend perpendicularly or substantially perpendicularly to the plane passing through the second and third axes 1*b* and 2*a*.

The at least one first contact element 3*a* may be mechanically connected to the first support part 3 via an elastically deformable connection. Here the elastic connection is for example constituted by the at least one arm 3*k* itself, which is able to bend and may be regarded as a leaf spring.

The at least one second contact element 4*e* may be mechanically connected to the at least one second support part 4 via an elastically deformable connection. Here the elastic connection is for example constituted by the arm 4*k* itself that is able to bend and may be regarded as a leaf spring.

Alternatively or additionally, ends of the arms or the ends of the arms could be biased toward predefined positions along the second and third axes 1*b* and 2*a* by elastically deformable elements such as springs.

Note that in this second embodiment if the device D is duplicated the contact elements are such that the contact elements 3*a*, 4*e* are moved away from the contact elements 3*a*', 4*e*' parallel to the second and third axes 1*b* and 2*a* when the lid of the box is closed. Alternatively, the contact elements may be such that the first contact elements are moved toward the second contact elements perpendicularly to the second and third axes 1*b* and 2*a* when the lid of the box is closed. Consequently, this second embodiment is very general purpose because it enables a timepiece component 5 to be retained either by the interior or by the exterior. This second embodiment is indicated for the storage of timepiece components of varied shapes such as for example a bezel, a middle, a calendar disk, a glass, a plate, a movement, a case or a dial.

In the various embodiments and in the various variants the rotary articulations, in particular about the axes 1*a* and/or 2*a* and/or 1*b* and/or A1, may for example take the form of a flexible film disposed at the interface of the parts to be articulated.

In the various embodiments and in the various variants the contact elements may be frustoconical or cylindrical with a circular section or a polygonal section.

In the various embodiments and in the various variants the contact elements 3*a*, 3*b*, 4*a*, 4*d*, 4*e*, 3*a*', 4*e*' may be constituted of one or more studs, a bar or a curve defining at least two points of contact with the timepiece component 5 or any other appropriate geometry. The contact of the timepiece component 5 with the contact elements may be continuous and/or discontinuous depending on the designs.

Figure 3:
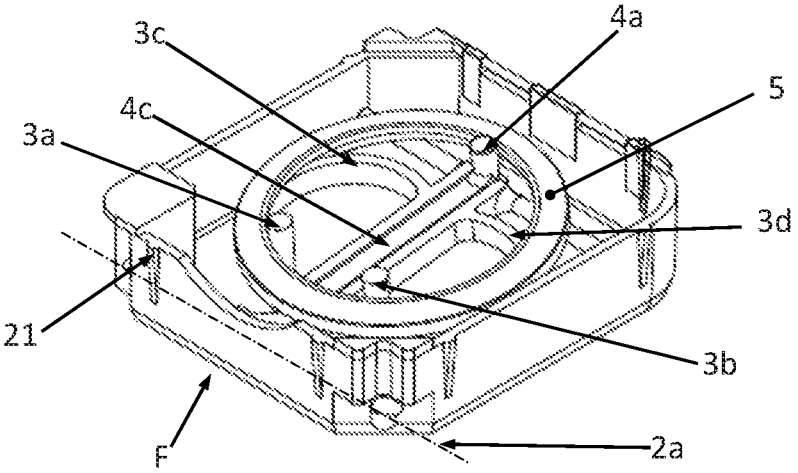
FIG. 3 is a view of the first variant of the first embodiment of the box for packaging the timepiece component in the closed position with the timepiece component in the box and the lid not shown.
Figure 4:
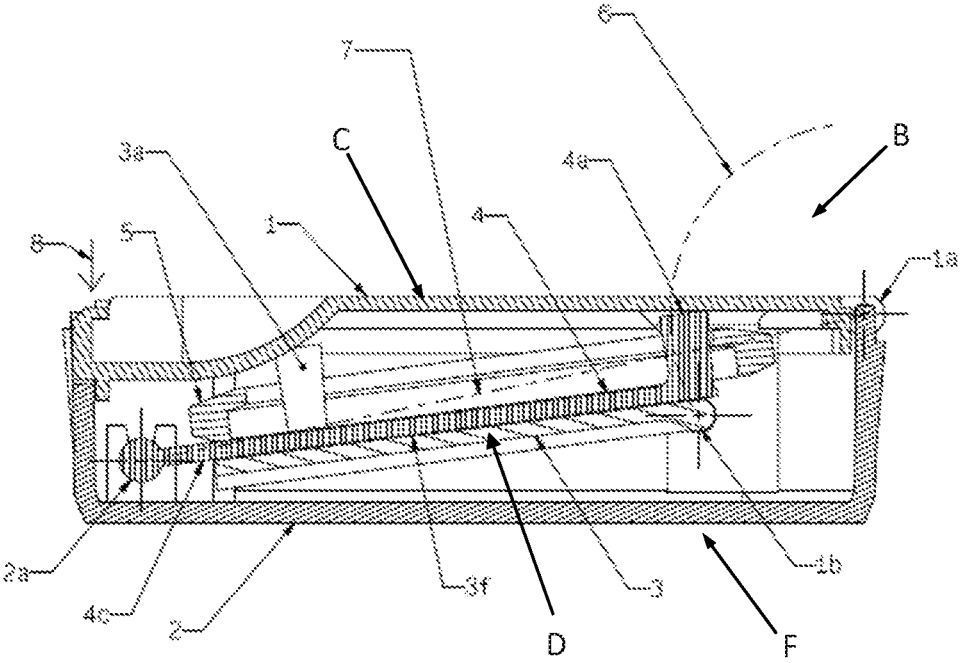
FIG. 4 is a section of the first variant of the first embodiment of the box for packaging the timepiece component in the closed position with the timepiece component in the box.
Figure 5:
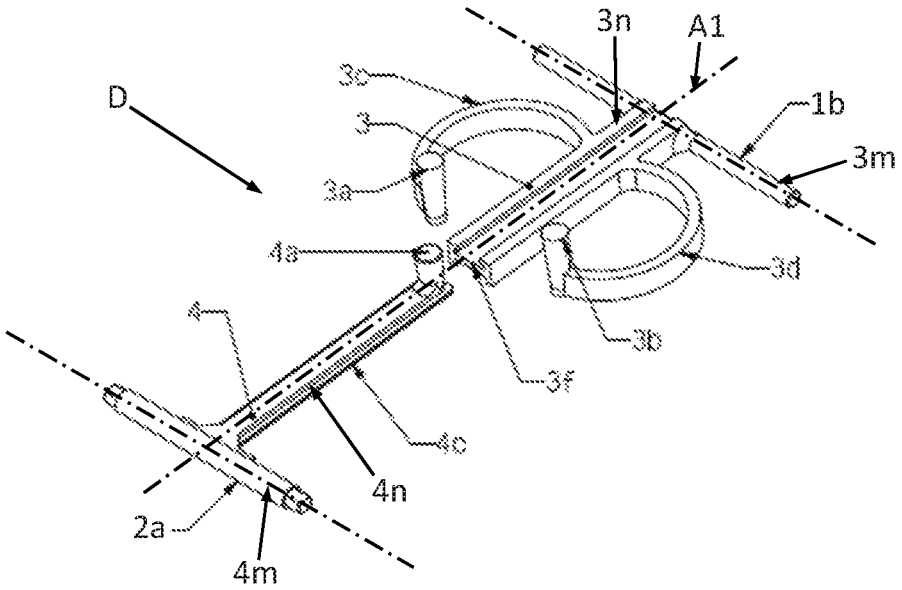
FIG. 5 is an exploded view of a support of the first variant of the first embodiment of the box for packaging the timepiece component.
Figure 6:
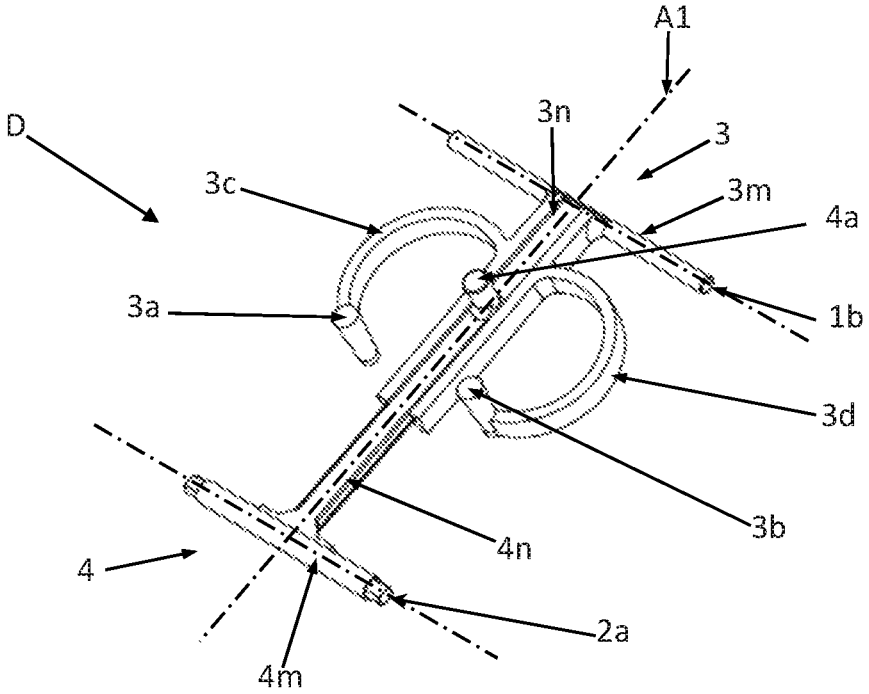
FIG. 6 is a perspective view of the support of the first variant of the first embodiment of the box for packaging the timepiece component, the support being in a first configuration.
Figure 7:
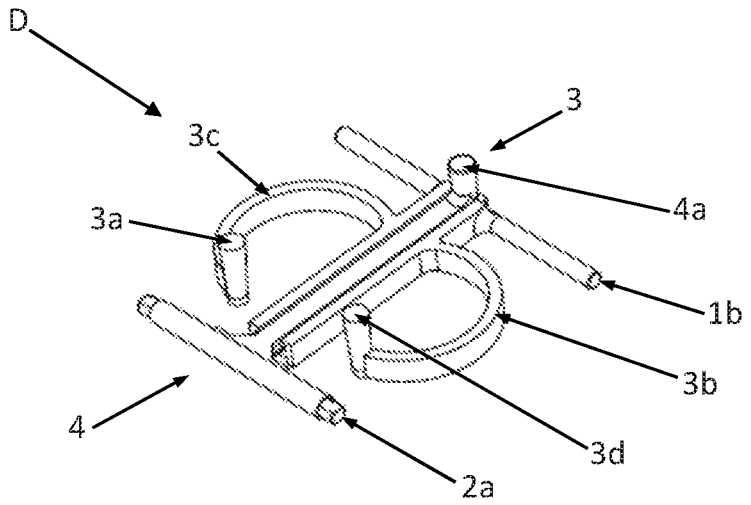
FIG. 7 is a perspective view of the support of the first variant of the first embodiment of the box for packaging the timepiece component, the support being in a second configuration.
Figure 8:
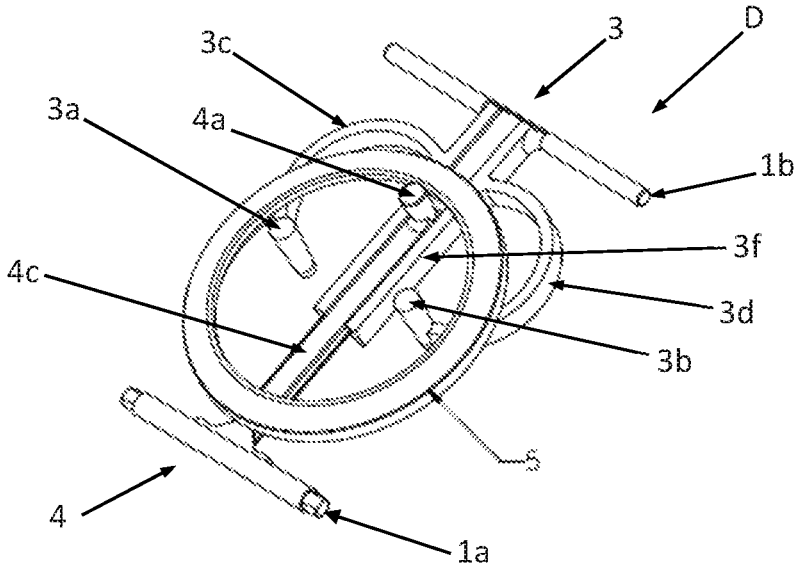
FIG. 8 is a perspective view of the support of the first variant of the first embodiment of the box for packaging the timepiece component, the support being in the first configuration and supporting a timepiece component.
Figure 9:
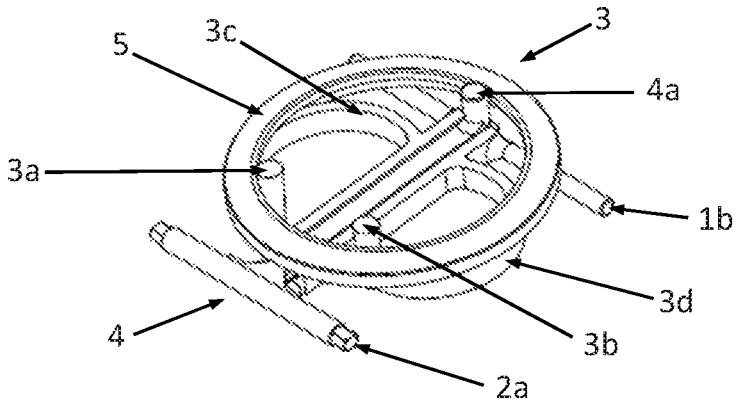
FIG. 9 is a perspective view of the first variant of the support of the first embodiment of the box for packaging the timepiece component, the support being in the second configuration and supporting a timepiece component.
Figure 10:
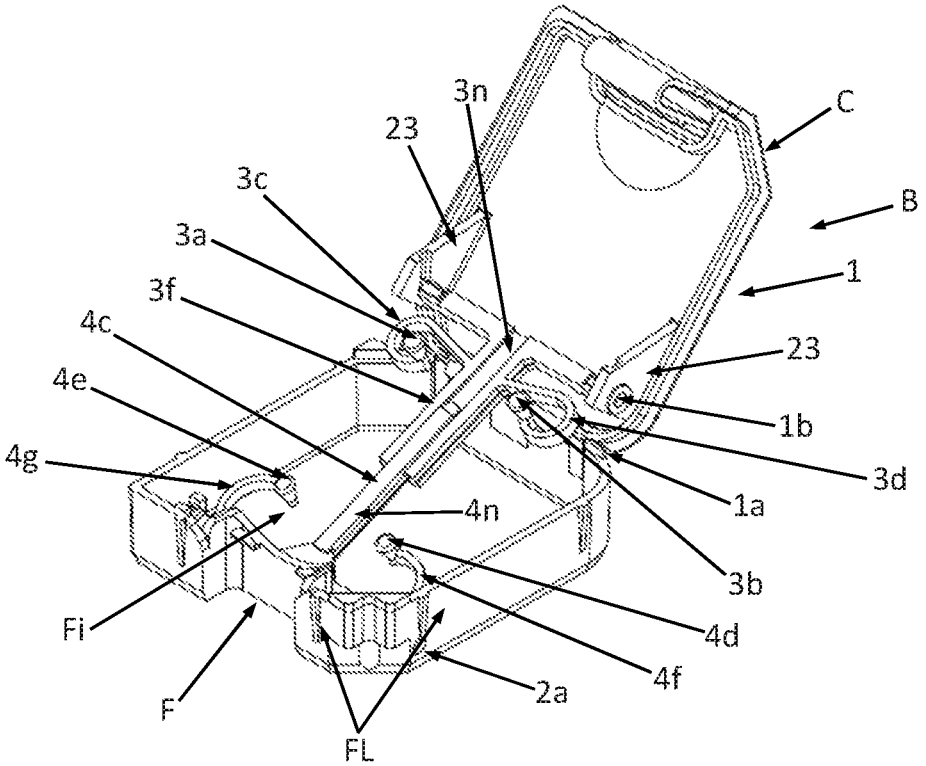
FIG. 10 is a view of a second variant of the first embodiment of a box for packaging a timepiece component in the open position.

In the various embodiments and in the various variants the function of the contact elements is to act on the timepiece component 5, to position it and to retain it in position as shown in FIGS. 3, 4 and 9. The contact elements are adapted to come to bear against one or more surfaces of the timepiece component 5.

In the various embodiments and in the various variants the contact elements are therefore preferably made of a flexible material or covered with a flexible material to avoid marking the timepiece component. The contact elements may be made from various known rigid or flexible materials, for example metal, polymer or shape memory foam. This list is not exhaustive of course. In order to improve the retention in position of the timepiece component the contact elements may advantageously include a projection or a depression such that when the contact elements are in contact with the timepiece component the contact elements espouse at least partly the shape of the latter.

In the various embodiments and in the various variants the timepiece component 5 is preferably retained at three points at least when the device D is in the retaining configuration.

In the various embodiments and in the various variants the contact elements may be disposed at will by the designer of the device D.

In the various embodiments and in the various variants the device D may include on the first support part 3 and/or on the second support part 4 at least one bearing zone adapted to be able to support the timepiece component 5, in particular to support the timepiece component 5 when the device D is not in a first state or configuration for retaining the timepiece component. The bearing zone may advantageously be constituted by or advantageously include at least one part of the bars 3*n*, 4*n* and/or the elastic connections and/or the leaf springs 3*c*, 3*d*, 4*f*, 4*g* and/or the arms 3*k*, 4*k* and/or the contact elements 3*a*, 3*b*, 4*a*, 4*d*, 4*e*, 3*a*', 4*e*'. In a complementary way, the support may include support elements to enable optimized retention of the component in a plane corresponding to the plane passing through the third axis 2*a* and the second axis 1*b* or in a plane parallel or substantially parallel to the plane passing through the third axis 2*a* and the second axis 1*b*.

In the various embodiments and in the various variants described above the retaining device D is an integral part of the box B. In particular, the control member 1 of the device is produced in the lid of the box B and/or the base 2 of the device is produced in the bottom of the box. However, the retaining device may be autonomous, i.e., produced with no box bottom or lid.

A retaining device of this kind may be adapted to suit manipulation of the timepiece component, for example for operations of lacquering, varnishing, sandblasting, dipping, galvanic treatment or treatment with a resist.

In the various embodiments and in the various variants the box B may be obtained by mounting an autonomous retaining device on a box structure, in particular on a box bottom and/or on a lid.

Figure 13:
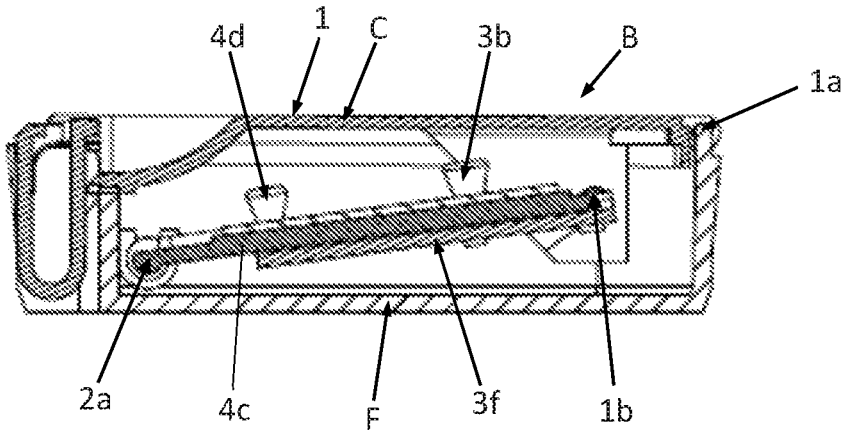
FIG. 13 is a section of the second variant of the first embodiment of the box for packaging the timepiece component in the closed position with the timepiece component in the box.
Figure 14:
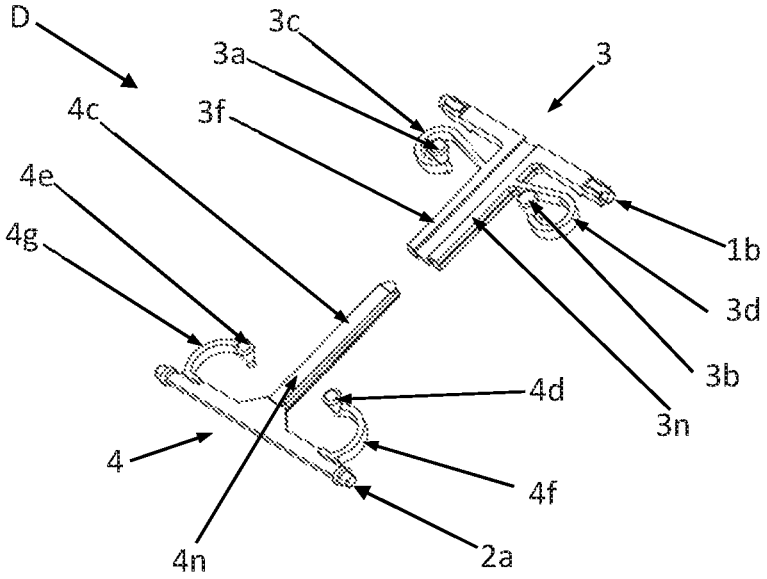
FIG. 14 is an exploded view of a support of the second variant of the first embodiment of the box for packaging the timepiece component.
Figure 15:
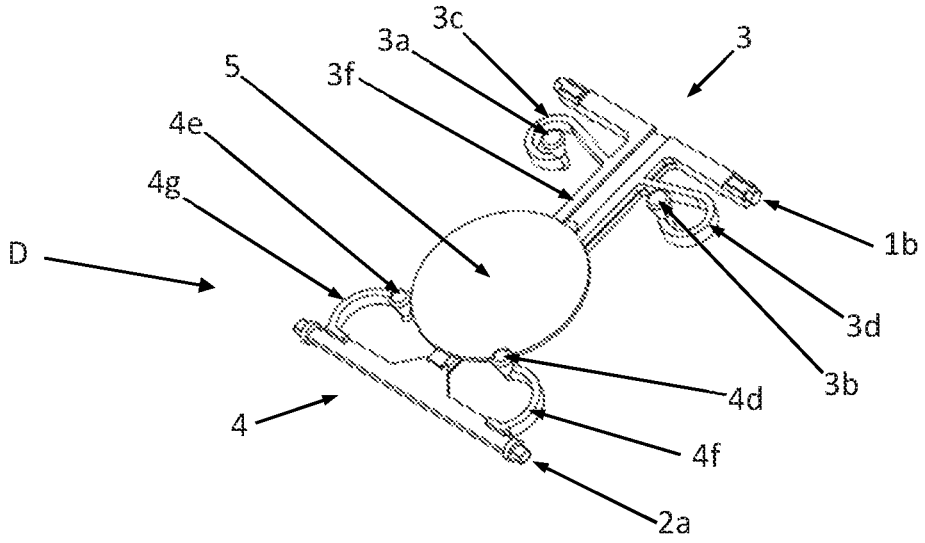
FIG. 15 is a perspective view of the support of the second variant of the first embodiment of the box for packaging the timepiece component, the support being in a first configuration.
Figure 16:
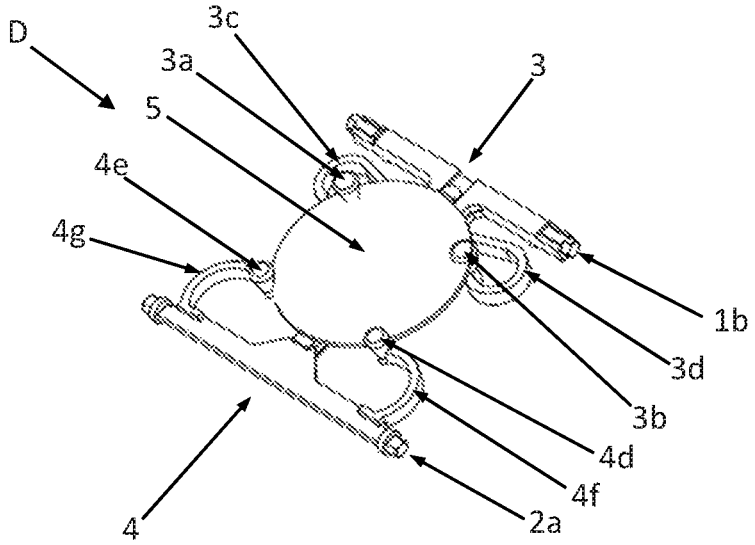
FIG. 16 is a perspective view of the support of the second variant of the first embodiment of the box for packaging the timepiece component, the support being in a second configuration.

In the various embodiments and in the various variants the device is advantageously such that when the control member 1 is pivoted the second axis 1*b* follows a trajectory 6 that intersects a plane defined as passing through the axis 2*a* and the axis 1*a* and the device is advantageously such that when the second axis 1*b* is positioned at the level of or below this intersection the timepiece component 5 applies a force enabling retention of the second axis 1*b* under the plane defined as passing through the axis 2*a* and the axis 1*a* as shown in the FIGS. 4 and 13 configurations.

In the various embodiments and in the various variants the box B may include one or more retaining devices. The box B may therefore contain as many timepiece components as retaining devices. The devices may be actuated simultaneously (by a common control member) or independently of one another (by as many dedicated control members as there are retaining devices).

In the various embodiments and in the various variants the box B preferably includes a single retaining device for retaining a single timepiece component. In this case, the box B is advantageously sized so as to be able to be inserted and stored with other identical or similar boxes in groupage packaging or in transport packaging.

In the various embodiments and in the various variants the retaining device D and/or the box B is or are made of plastic material such as in particular polyethylene or polypropylene or polyvinylchloride or polystyrene or ABS.

In the various embodiments and in the various variants the first, second and third axes are preferably parallel.

In the various embodiments and in the various variants the first, second and fourth axes are preferably parallel.

In the various embodiments and in the various variants the elastically deformable connection or connections preferably include(s) an elastically flexible blade 3*c*, 3*d*; 4*f*, 4*g*, in particular a curved blade and/or a blade extending at the level of the contact element parallel or substantially parallel to the surface of the timepiece component 5 on which the contact element is intended to come to bear.

In the various embodiments and in the various variants the packaging box is preferably such that the state of the support is determined by the position of a lid of the box.

The operation of a retaining device or of a box as described above is now explained hereinafter.

It is assumed that the box B is initially open and/or the retaining device is positioned in the first configuration. This first configuration is a configuration in which a timepiece component 5 would not be retained. In this configuration, the device is preferably positioned so as to facilitate the holding of the timepiece component 5 so as to avoid damaging the timepiece component 5.

Figure 2:
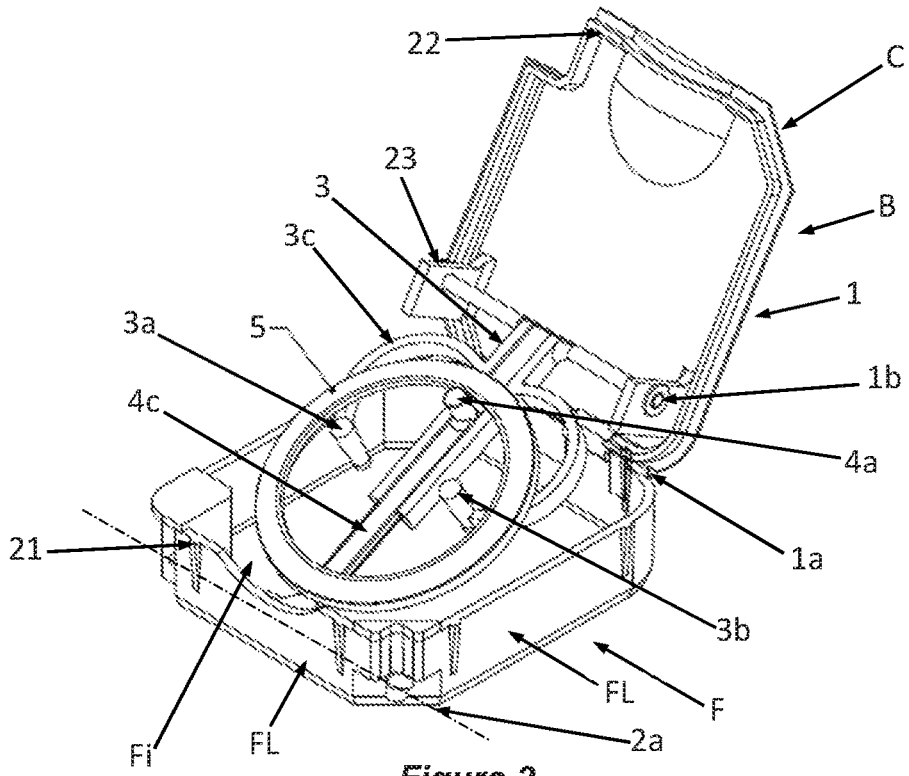
FIG. 2 is a view of a first variant of the first embodiment of the box for packaging the timepiece component in the open position with the timepiece component in the box.
Figure 11:
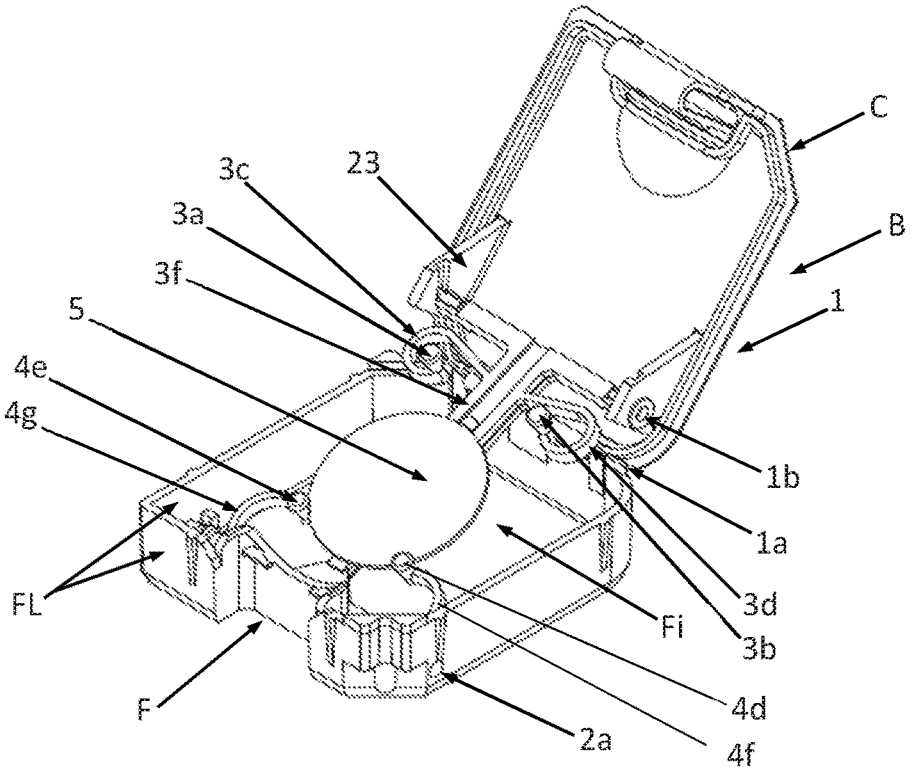
FIG. 11 is a view of the second variant of the first embodiment of the box for packaging the timepiece component in the open position with the timepiece component in the box.
Figure 21:
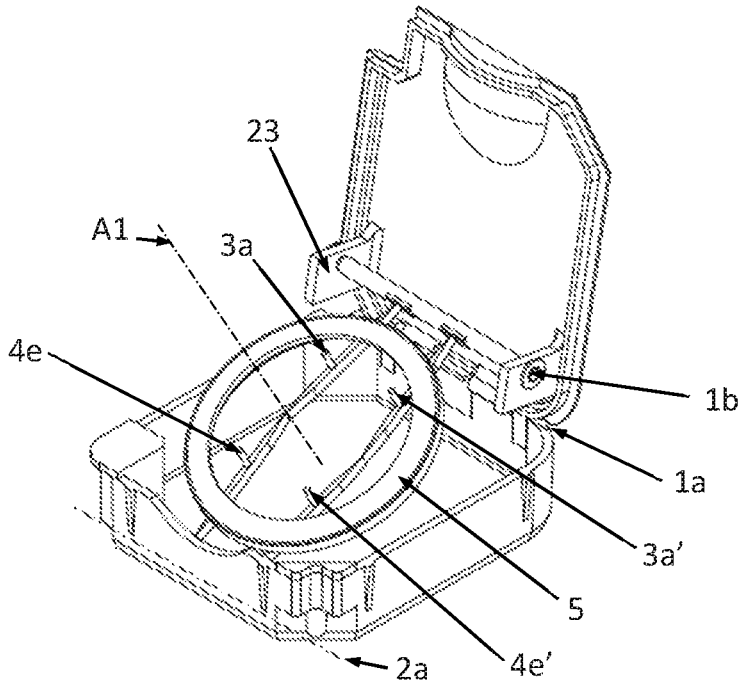
FIGS. 21 and 22 are views of the second embodiment of the box for packaging the timepiece component in the open and half-open positions with the timepiece component in the box.

In this first configuration, the timepiece component 5 is placed on the retaining device, in particular on the support, notably on a bearing zone adapted to be able to support the timepiece component 5 when the device D is in the first configuration. In the case of the third variant of the first embodiment the timepiece component 5 may be placed on the supplementary contact elements 3*x*, 3*y*. Following this step, a situation shown in FIGS. 2, 11 and 21 is obtained.

Figure 12:
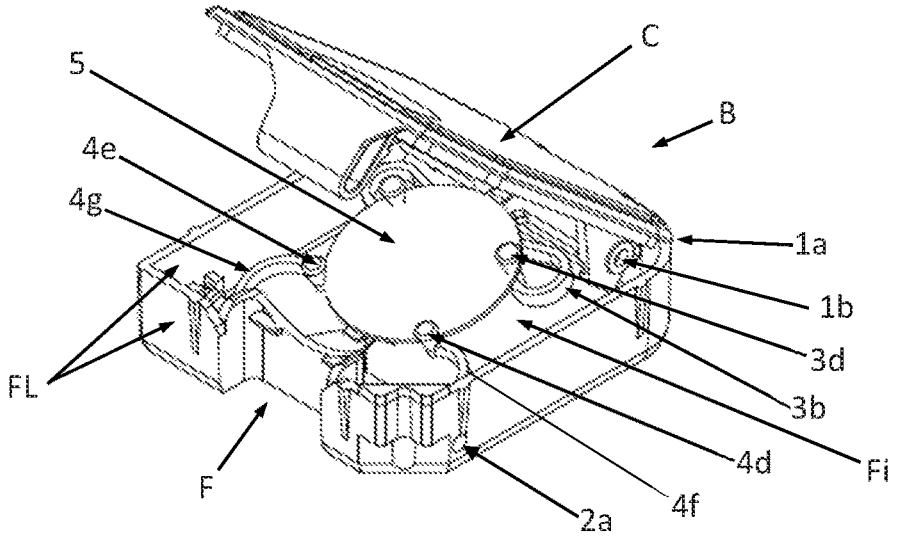
FIG. 12 is a view of the second variant of the first embodiment of the box for packaging the timepiece component in the half-open position with the timepiece component in the box.
Figure 22:
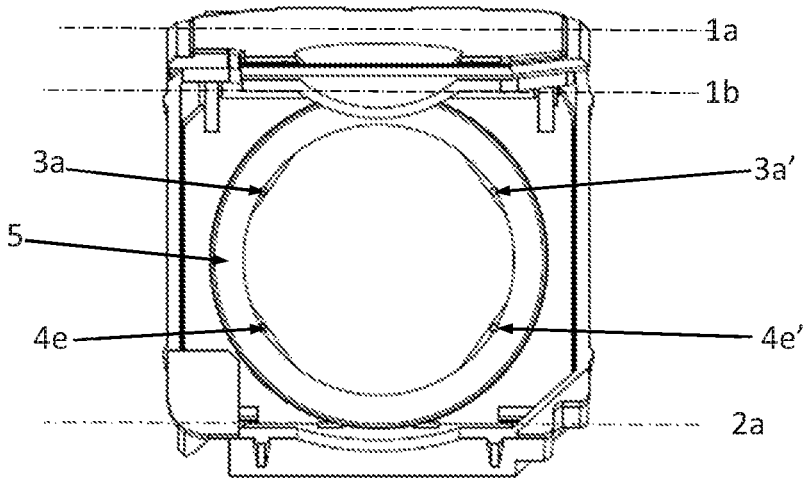
Figure 23:
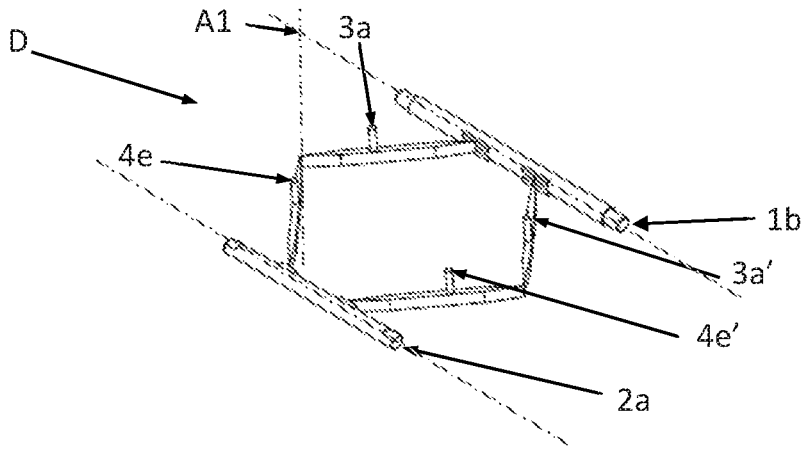
FIG. 23 is a perspective view of the support of the second embodiment of the box for packaging the timepiece component, the support being in a first configuration.

The control member 1 of the retaining device D and/or the lid C of the box B is then acted on. In particular, the control member 1 and/or the lid is turned about the axis 1*a*. As a consequence of that action, the support is deformed by movement of the first support part 3 relative to the second support part (sliding in translation in the three variants of the first embodiment and rotating in the second embodiment). In the case of the third variant of the first embodiment this action moves the shaft in the grooves 6 until the projections 4*e* and 4*f* come to bear against the timepiece component 5. To this end, the projections 40*e* and 40*f* cooperate with through cut-outs 40*g*, 40*h* in the first part. This movement action is maintained until all the contact elements arrive in contact with the timepiece component 5 as shown in FIGS. 12, 18 and 22.

This action of movement of the control member and/or the lid is further maintained beyond the contact of the contact elements with the timepiece component 5. This is made possible by the elastic deformation of the elastic connections described above and via which the contact elements are mounted on the support. The action of movement of the control member and/or of the lid is then effected against the action of the elastic connections 3*c*, 3*d*, 4*f*, 4*g*, 3*k*, 4*k* until an unstable equilibrium position is reached in which the axes 1*a*, 1*b* and 2*a* or 1*a*, 1*b*, 1*c* are in the same plane. In this unstable equilibrium position maximum elastic potential energy is stored in the device, notably in the support, in particular in the elastic connections.

Beyond this unstable equilibrium position the action of movement of the control member and/or of the lid may be effected with the aid of the action of the elastic connections until an abutment position is reached, in particular a position of contact of the abutment 21 with the abutment 22. The lid C is pressed against the bottom in the direction of the arrow 8. Means for locking the box B between the lid C and the bottom F, for example clips, latches, self-grip attachment means, are therefore not necessarily needed. They may nevertheless be provided. The box B and the device D are then a closed configuration or retaining configuration shown in FIGS. 3, 4, 13.

In this second configuration, the component is perfectly retained by the retaining device through the action of the contact elements.

The procedure to go from the second configuration to the first configuration is the reverse of that described above.

It is to be noted that the box B and/or the retaining device D could be such that on closing the lid of the box there is at no time passage through an unstable equilibrium position as described above. In this case, the action of movement of the lid is effected against the action of the elastic connections as soon as the contact elements come into contact with the timepiece component 5 up to closing of the lid. In this case, means are preferably provided for locking the box B between the lid C and the bottom F, for example clips, latches, self-grip attachment means.

Means may also be provided for locking the box B between the lid C and the bottom F, for example by clips, latches, self-grip attachment means, even if the box B and/or the retaining device D is or are such that on closing the lid of the box there is movement through an unstable equilibrium position as defined above.

The box B described above may be used for the transportation, handling or storage of timepiece components of diverse shapes, or even more generally of objects of diverse shapes.

The box B firstly enables optimum protection of a timepiece component 5 from accidental impact, from being dropped and from vibration during transportation. The box B also enables a timepiece component 5 to be protected from its environment during storage. The box B also enables accommodation of the widest possible range of parts with different dimensions. Moreover, the introduction and the extraction of the object are facilitated compared to known prior art packaging.

To this end, as described above, the retaining device enables in a first configuration facilitated holding of the timepiece component 5 with no risk of damaging it and in a second configuration adequate retention of the timepiece component 5 in place in order to protect it from any impact.

The invention also concerns a box B for packaging a timepiece component 5 including at least one support 3, 4 adapted to receive the timepiece component and configurable between a first state retaining the timepiece component and a second state releasing the timepiece component.

The invention claimed is:

1. A device for retaining in position a timepiece component, the device including:

a base;

a support comprising a first part and a second part, the first part being mounted so as to be mobile relative to the second part;

a first contact element adapted to come to bear against the timepiece component, the first contact element being mounted on the first part, and a second contact element adapted to come to bear against the timepiece component, the second contact element being mounted on the second part; and a control member mounted so as to pivot on the base about a first axis and pivoting the first part about a second axis.

2. The device as claimed in claim 1, wherein the second part is mounted so as to be mobile relative to the base about a third axis.

3. The device as claimed in claim 1, wherein the first and second parts are connected by a prismatic joint or a sliding connection.

4. The device as claimed in claim 2, wherein the first and second parts are connected by a pivot connection having a fourth axis perpendicular or substantially perpendicular to a plane passing through the first and third axes.

5. The device as claimed in claim 4, wherein the first part includes at least one first arm and the second part includes a second arm.

6. The device as claimed in claim 5, wherein the first arm is articulated at the level of the second axis parallel to the fourth axis and wherein the second arm is articulated at the level of the third axis parallel to the fourth axis.

7. The device as claimed in claim 4, including at least two first parts and at least two second parts.

8. The device as claimed in claim 1, wherein the second part is mounted so as to be immobile relative to the base.

9. The device as claimed in claim 1, wherein the first part is mounted so as to be mobile relative to the second part by a pivot connection, wherein a fifth axis of the pivot connection is mobile in a slide.

10. The device as claimed in claim 1, wherein the device is arranged so that, when the control member is moved to pivot about the first axis, the second axis follows a trajectory that intersects a plane defined as passing through:

the third axis or the fifth axis, and the first axis, and so that when the second axis is positioned at this intersection maximum elastic potential energy is stored in the device.

11. The device as claimed in claim 1, wherein at least one selected from the group consisting of:

the second part is mounted so as to be mobile relative to the base about a third axis;

the first part is mounted so as to be mobile relative to the second part about a fifth axis and the contact elements extend perpendicularly or substantially perpendicularly to a plane passing through the second and third axes or through the second and fifth axes;

the contact elements are frustoconical;

at least one of the first and second contact elements is mounted on the support via an elastically deformable connection; and at least one of the first and second support parts is mounted on the base or on the control member via an elastically deformable connection.

12. The device as claimed in claim 3, wherein one of the first part and the second part forms a rail and the other of the first part and the second part forms a slide.

13. The device as claimed in claim 9, wherein the slide has an axis perpendicular to the first axis.

14. The device as claimed in claim 9, wherein the slide has an axis perpendicular to the first axis.

15. A box for packaging a timepiece component including at least one retaining device as claimed in claim 1.

16. The packaging box as claimed in claim 15, wherein the retaining device is mounted on a box structure.

17. The packaging box as claimed in claim 15, wherein an element of the retaining device is made in one piece with the box structure.

18. The packaging box as claimed in claim 15, wherein the box includes a lid articulated on a box bottom about the second axis, the control member consisting of the lid.

19. The packaging box as claimed in claim 15, wherein the retaining device is mounted on a bottom of the box structure.

20. The packaging box as claimed in claim 17, wherein the base of the retaining device is made in one piece with the bottom of the box structure.

* * * * *